US009141050B2

(12) United States Patent
Kasuya et al.

(10) Patent No.: US 9,141,050 B2
(45) Date of Patent: Sep. 22, 2015

(54) FIXING APPARATUS

(71) Applicant: CANON KABUSHIKI KAISHA, Tokyo (JP)

(72) Inventors: Yoshisuke Kasuya, Susono (JP); Hideki Ohta, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/182,867

(22) Filed: Feb. 18, 2014

(65) Prior Publication Data

US 2014/0233995 A1 Aug. 21, 2014

(30) Foreign Application Priority Data

Feb. 19, 2013 (JP) ..... 2013-029721
Jan. 24, 2014 (JP) ..... 2014-010990

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/107, 110, 122, 320, 328, 329; 219/216, 619
See application file for complete search history.

(56) References Cited

U.S. PATENT DOCUMENTS

2011/0103808 A1 5/2011 Abe et al.
2011/0103809 A1 5/2011 Kuwata et al.
2012/0201558 A1* 8/2012 Watanabe ..... 399/69
2013/0195532 A1 8/2013 Abe et al.
2013/0302060 A1 11/2013 Moriya et al.
2013/0336672 A1 12/2013 Mizuta et al.

FOREIGN PATENT DOCUMENTS

JP 2002-110313 A 4/2002
JP 2002-122489 A 4/2002
JP 2002-181630 A 6/2002
JP 2002-267542 A 9/2002
JP 2002-267543 A 9/2002
JP 2003-271006 A 9/2003
JP 2005-266505 A 9/2005
JP 2007-310066 A 11/2007
JP 2010-266706 A 11/2010

* cited by examiner

*Primary Examiner* — Hoan Tran

(74) *Attorney, Agent, or Firm* — Fitzpatrick, Cella, Harper & Scinto

(57) ABSTRACT

A fixing apparatus includes a heater; a heater holding member for holding the heater; a temperature sensor, provided in contact with the heater through a hole provided in the heater holding member, for detecting a temperature of the heater; a holder for holding the sensor; and an urging member, provided between the sensor and the holder, for urging the sensor toward the heater, wherein the heater holding member includes a positioning portion for determining a position of the holder with respect to an urging direction of the urging member, and wherein the positioning portion is disposed at a position outside of a position of the sensor with respect to a direction perpendicular to a longitudinal direction of the heater.

8 Claims, 6 Drawing Sheets

PRIOR ART

FIXING APPARATUS

FIELD OF THE INVENTION AND RELATED ART

The present invention relates to a fixing apparatus (or device) for fixing a toner image to a sheet of a recording medium, after the transfer of the toner image onto the sheet.

An electrophotographic image forming apparatus such as an electrophotographic printer has a fixing device, which applies heat and pressure to a toner image on a sheet of a recording medium after the toner image is transferred onto the sheet. One of various devices is a fixing device of the so-called film type.

FIGS. 5(*a*)-5(*c*) are drawings for showing the structure of a part of a fixing apparatus of the film type. More specifically, FIG. 5(*a*) is a schematic sectional view of the film unit of the fixing apparatus, and in particular, the temperature sensor of the device and its adjacencies, at a vertical plane parallel to the lengthwise direction (indicated by arrow mark X) of the fixing device. It shows the internal structure of the film unit. FIG. 5(*b*) is a schematic cross-sectional view of the film unit, at a plane b-b in FIG. 5(*a*). FIG. 5(*c*) is a perspective view of the temperature sensor, and its adjacencies, of the film unit.

Referring to FIGS. 5 (*a*)-5(*c*), the fixing apparatus of the so-called film type employs a heater 200, which is made up of a ceramic substrate, and a heat generating member formed on the ceramic substrate by printing. The heater 200 is held by a heater holding member 201. A cylindrical film 233 is fitted around the heater holding member 201. A pressure roller (unshown) is kept pressed against the heater 200, with the placement of the film 233 between the pressure roller and heater 200. While a sheet of a recording medium on which an unfixed toner image is present is conveyed through the nip between the pressure roller and film 233, the toner image is melted, and becomes fixed to the sheet.

A fixing apparatus such as the one described above is provided with a temperature sensor 202 for detecting the temperature of the heater 200.

In order to ensure that the temperature sensor 202 accurately detects the temperature of the heater 200, the fixing device is provided with a pressuring member 203, which keeps the temperature sensor 202 in contact with the heater 200. The pressuring member 203 is held by a sensor holding member 204 fixed to the heater holding member 201. It keeps the temperature sensor 202 pressed toward the heater 200.

The heater holding member 201 is provided with a pair of bosses 230, which are put through a pair of through holes 231, one for one, with which the sensor holding member 204 is provided. After the bosses 230 are put through the through holes 231, one for one, the bosses 230 are fitted with a pair of fasteners 232, such as locking rings, to fix the sensor holding member 204 to the heater holding member 201 to keep the sensor holding member 204 precisely positioned relative to the heater holding member 201. A numerical referential code 206 depicts a metallic stay which plays the role of reinforcing the heater holding member 201.

If the dimension W2 of the sensor unit, in terms of the direction parallel to the lengthwise direction (indicated by arrow mark X) of the heater 100, is large, it is possible that the temperature sensor 202 will not be desirably positioned. For example, in a case where additional sensor units and/or protective elements such as a thermo-switch have to be positioned next to the sensor unit, the temperature sensor 202 cannot be desirably positioned. Therefore, a fixing device such as the one described above needs a substantial amount of space for allowing the sensor holding member 204 to be fastened to the heater holding member 201. Thus, the dimension W2 has to be substantial, in order to provide the spaces for fastening the sensor holding member 204 to the heater holding member 201. In some cases, therefore, it is possible that the positioning of the sensor unit will be restricted.

SUMMARY OF THE INVENTION

According to an aspect of the present invention, there is provided a fixing apparatus comprising a heater; a heater holding member for holding the heater; a temperature sensor, provided in contact with the heater through a hole provided in the heater holding member, for detecting a temperature of the heater; a sensor holding member for holding the temperature sensor; and an urging member, provided between the temperature sensor and the sensor holding member, for urging the temperature sensor toward the heater, wherein the heater holding member includes a positioning portion for determining a position of the sensor holding member with respect to an urging direction of the urging member, and wherein the positioning portion is disposed at a position outside of a position of the temperature sensor with respect to a direction perpendicular to a longitudinal direction of the heater.

Further features of the present invention will become apparent from the following description of exemplary embodiments (with reference to the attached drawings).

DESCRIPTION OF THE PREFERRED EMBODIMENTS

Hereinafter, an embodiment of the present invention is described in detail with reference to the appended drawings.

(General Structure of Image Forming Apparatus)

Figure 1:
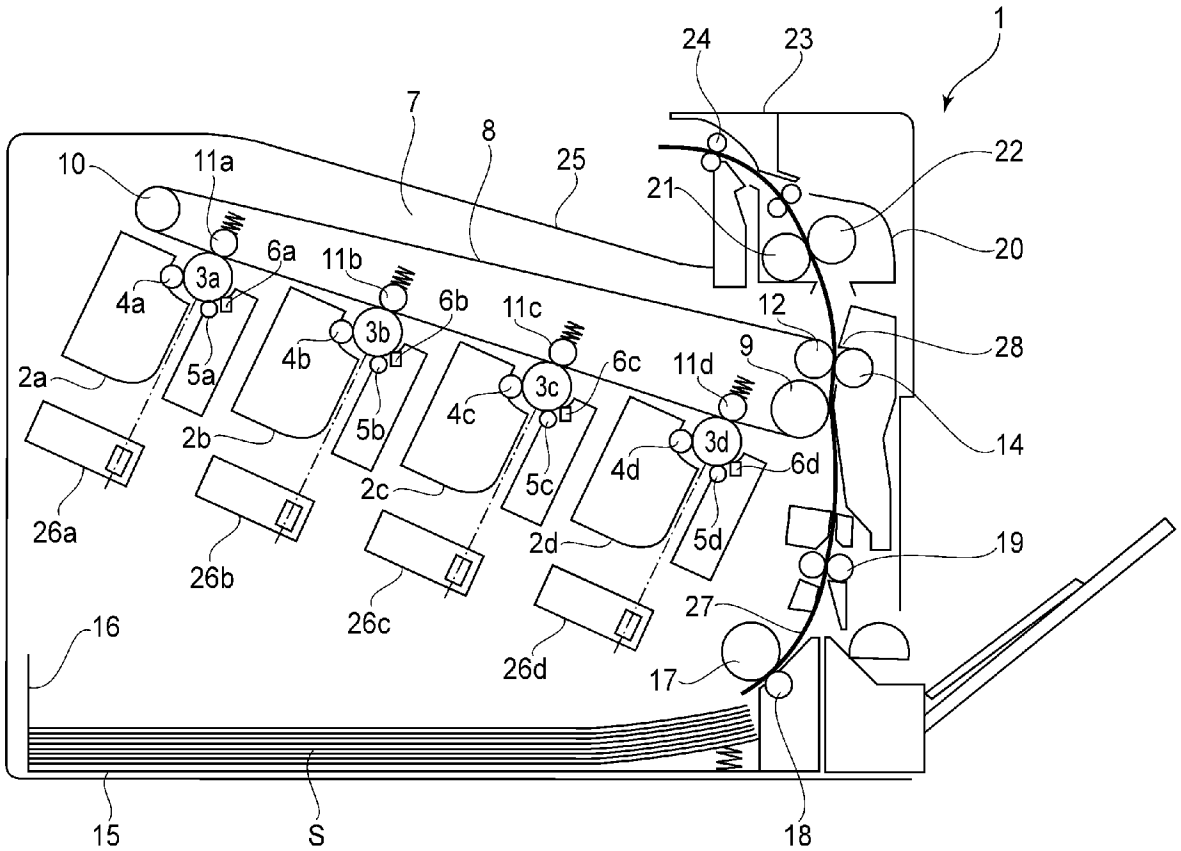
FIG. 1 is a schematic sectional view of a typical image forming apparatus to which the present invention is applicable.

FIG. 1 is a drawing for showing the structure of the image forming apparatus.

Referring to FIG. 1, the image forming apparatus 1 is provided with four image formation units 2*a*, 2*b*, 2*c*, and 2*d* which form four toner images, different in color, one for one. It is also provided with an intermediary transfer belt unit 7 having an intermediary transfer belt 8, and a fixing device 20.

The image formation units 2*a*, 2*b*, 2*c* and 2*d* have photosensitive drums 3*a*, 3*b*, 3*c* and 3*d*, respectively. They are provided with charge rollers 5*a*, 3*b*, 5*c* and 5*d*, development rollers 4*a*, 4*b*, 4*c* and 4*d*, and cleaning blade 6*a*, 6*b*, 6*c* and 6*d*, which are arranged in the listed order, in the adjacencies of the peripheral surfaces of the photosensitive drums 3*a*, 3*b*, 3*c* and 3*d*, respectively. Further, the image formation units 2*a*, 2*b*, 2*c* and 2*d* are aligned in parallel in the listed order, along the intermediary transfer belt 8.

The charge rollers 5*a*, 5*b*, 5*c* and 5*d* uniformly charge the peripheral surfaces of the photosensitive drums 3*a*, 3*b*, 3*c* and 3*d*, respectively.

Electrostatic latent images, which correspond one for one to multiple monochromatic image, different in color, into which an image to be formed has been separated, are formed on the peripheral surfaces of the photosensitive drums 3*a*, 3*b*, 3*c* and 3*d* by a laser-based exposing devices 26*a*, 26*b*, 26*c* and 26*d*, respectively. The development rollers 4*a*, 4*b*, 4*c* and 4*d* develop the electrostatic latent images on the photosensitive drums 3*a*, 3*b*, 3*c* and 3*d*, with the use of toners, one for one, which are different in color.

The cleaning blade 6*a*, 6*b*, 6*c* and 6*d* remove the transfer residual toner, that is, the toner remaining adhered to the peripheral surfaces of the photosensitive drums 3*a*, 3*b*, 3*c* and 3*d* after the transfer of the toner images from the photosensitive drums 3*a*, 3*b*, 3*c* and 3*d*, respectively.

The intermediary transfer belt unit 7 has: the intermediary transfer belt 8; and a combination of a driver roller 9, a tension roller 10, primary transfer rollers 11*a*, 11*b*, 11*c* and 11*d*, and a belt backing roller 12, by which the intermediary transfer belt 8 is suspended and kept stretched. As the driver roller 9 is rotationally driven by a belt driving motor (unshown), the intermediary transfer belt 8 is circularly moved.

The image forming apparatus 1 is structured so that the primary transfer rollers 11*a*, 11*b*, 11*c* and 11*d* oppose the photosensitive drums 3*a*, 3*b*, 3*c* and 3*d*, respectively, with the intermediary transfer belt 8 being sandwiched between the primary transfer rollers 11 and photosensitive drums 3, forming thereby primary transfer stations, one for one.

Further, the image forming apparatus 1 is provided with a secondary transfer roller 14, which opposes the belt backing roller 12, with the intermediary transfer belt 8 being sandwiched between the two rollers 14 and 12, forming thereby the secondary transfer station 28.

There is a sheet feeding device 15 in the bottom portion of the image forming apparatus 1. The sheet feeding device 15 conveys a sheet S of a recording medium to the secondary transfer station 28. It has a feed roller 17 which feeds a sheet S of the recording medium into the main assembly of the image forming apparatus 1 from a cassette 16 which stores multiple sheets S of the recording medium in layers. It has also a separation roller 18.

As the feed roller 17 is rotated, the sheets S of the recording medium stored in layers in the cassette 16 are fed one by one into the main assembly of the image forming apparatus 1. Then, each sheet S of the recording medium is conveyed to a pair of registration rollers 19 by way of a recording medium conveyance passage 27. Then, it is conveyed by the pair of registration rollers 19 to the secondary transfer station 28.

In the second transfer station 28, the multiple monochromatic toner images, different in color, on the intermediary transfer belt 8, are transferred (secondary transfer) onto the sheet S.

The fixing device 20 has a film unit 21 and a pressure roller 22, which are pressed upon each other, forming thereby a fixation nip, as a heating nip, between them.

The sheet S on which the unfixed toner images, different in color, are present, is conveyed to the fixation nip, and then, is conveyed through the fixation nip, remaining pinched by the film unit 21 and pressure roller 22, and being subjected to heat. Consequently, the unfixed toner images become fixed to the sheet S. After the sheet S is conveyed through the fixation nip, it is discharged by a pair of discharge rollers 24, with which a discharge unit 23 is provided, into a delivery tray 25.

(Structure of Fixing Device)

Figure 2A:
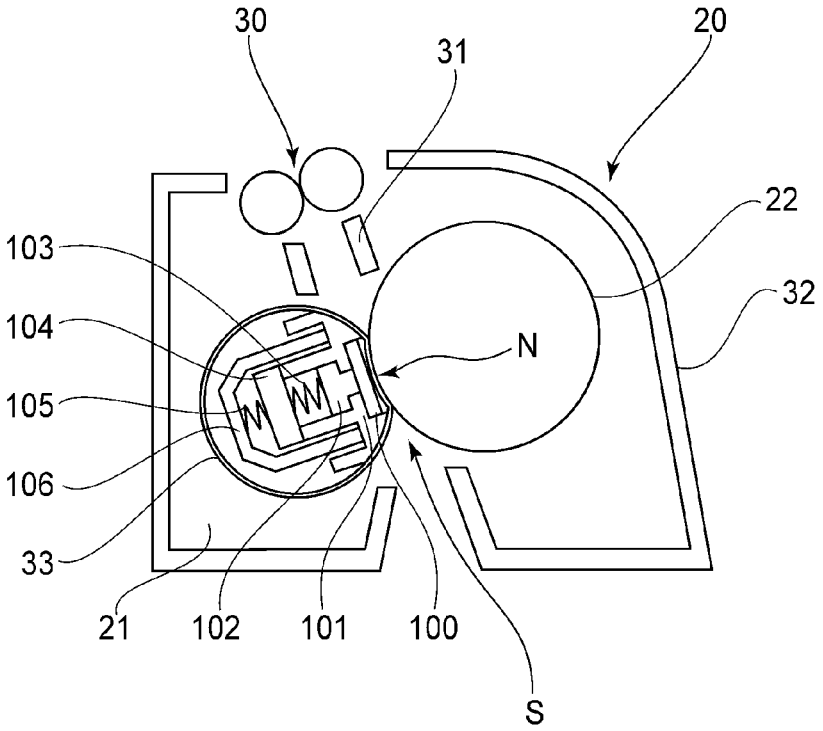
FIG. 2A is a sectional view of the fixing device in accordance with the present invention.
Figure 2B:
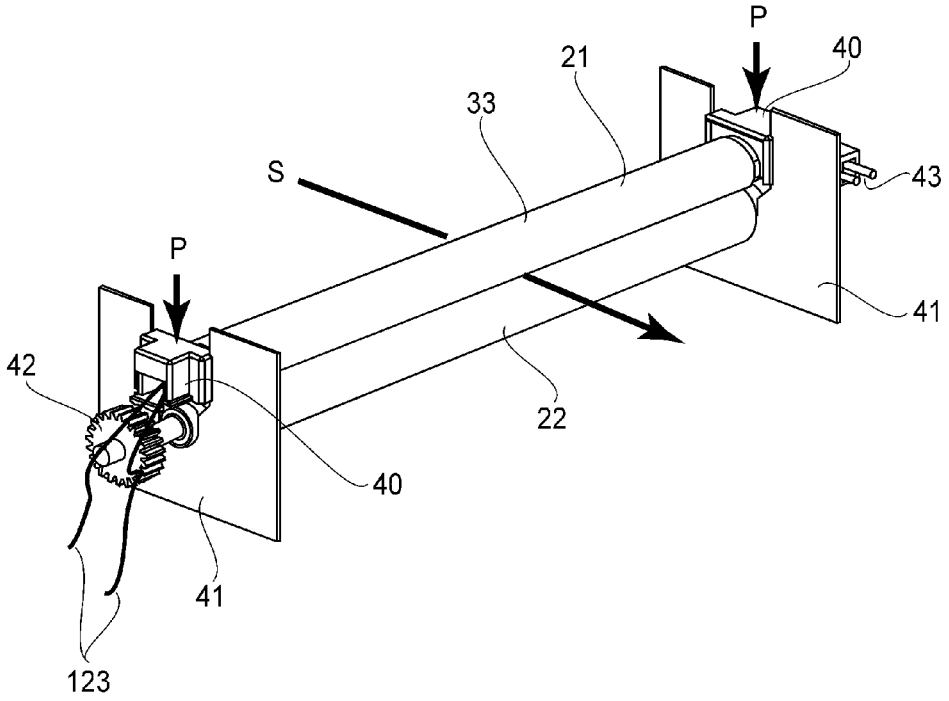
FIG. 2B is a perspective view of the fixing device.

FIGS. 2A and 2B are sectional and perspective views, respectively, of the fixing device 20. They show the structure of the fixing device 20.

Referring to FIGS. 2A and 2B, the fixing device 20 has: the film unit 21; a pressure roller 22; a pair of sheet conveyance rollers 30; a pair of sheet conveyance guide 31; an external casing 32 formed of resin; and a metallic frame 41 placed in the external casing 32.

The film unit 21 has a heater 100, a heater holding member 101, a temperature sensor 102, a pressing member (first pressing member) 103, a sensor holding member 104, a second pressing member 105, and a stay 106. The heater 100 is a ceramic heater, which is made up of a ceramic substrate, and a heat generating member formed on the ceramic substrate by printing. The material for the heater holding member 101 and the sensor holding member 104 is heat resistant resin, such as LCD (Liquid Crystal Polymer).

The fixing device 20 is provided with a cylindrical film, which is fitted around the film unit 21. The pressure roller 22 is driven by an unshown motor, through a pressure roller gear 42. The film 33 is rotated by the friction which occurs between the film 33 and the pressure roller 22 as the pressure roller 22 is driven; the film 33 is rotated by the rotation of the pressure roller 22. The material for the substrate layer of the film 33 is a resinous substance such as polyimide, or a metallic substance such as stainless steel.

The heater 100 is in contact with the inward surface of the film 33. The film unit 21 is kept pressed against the pressure roller 22, with the placement of the film 33 between the film unit 21 and the pressure roller 22, forming thereby a fixation nip N, through which a sheet S of the recording medium is conveyed. As electric power is supplied to the heater 100 through a connector 43, the heater 100 generates heat, which is transferred to the film 33 to be used for the fixation of the toner images on the sheet S.

Reference numeral 40 denotes a regulating member for regulating the movement of the film 33 in the direction parallel to the generatrix of the film 33. Referring to FIGS. 2A and 2B, the pressure roller 22 is rotatably supported by the frame 41. The film unit 21 is attached to the frame 41 from the top side of the pressure roller 22; it is attached to the frame 41 after the pressure roller 22 is rotatable supported by the frame 41. The film unit 21 is provided with a pair of regulating members 40, which are positioned at the lengthwise ends of the film unit 21. The regulating members 40 are kept under a preset amount of load applied in the direction indicated by a pair of arrow marks P, one for one. These loads P are the forces for forming the fixation nip N. As a sheet S of the recording medium, which is bearing an unfixed toner image (or unfixed toner images, different in color), is conveyed through the area of contact (fixation nip N) between the film unit 21 and the pressure roller 22, the sheet S comes into contact with the film 33. Thus, the heat from the heater 100 is transferred to the sheet S, and also, the sheet S is subjected to the pressure generated by the load P. Consequently, the unfixed toner image on the sheet P becomes fixed to the sheet S.

Figure 3:
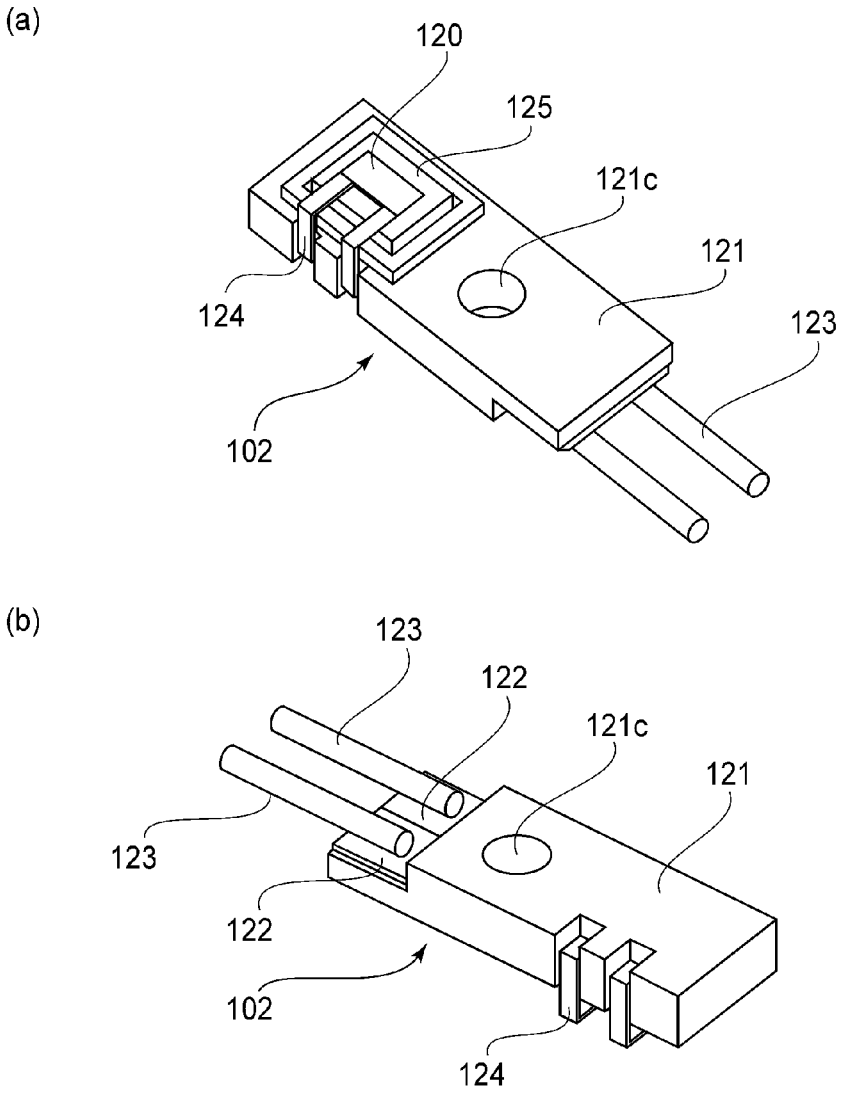
FIGS. 3(*a*) and 3(*b*) are perspective views of the temperature sensor.

FIGS. 3(*a*) and 3(*b*) are drawings showing the structure of the temperature sensor 102. More specifically, FIG. 3(*a*) is a perspective view of the temperature sensor 102. It shows the surface of the temperature sensor 102, on which a thermistor or thermistor chip (temperature detection element) 120 is present. FIG. 3(*b*) is a perspective view of the temperature sensor 102. However, it shows the opposite surface of the thermistor 120 from the surface shown in FIG. 3(*a*), that is, the surface of the temperature sensor 102, on which the thermistor chip 120 is not present.

The temperature sensor 102 has the thermistor chip 120 and a thermistor holder 121. The thermistor holder 121, which holds the thermistor chip 120, is required not to be deformed by the heat generated by the heat 100. Therefore, it is formed of heat resistant thermoplastic resin (LCP).

The thermistor holder 121 is provided with an electrically conductive metallic plate 122, which is integrated into the thermistor holder 121 while the thermistor holder 121 was formed by molding. The metallic plate 122 is connected to a pair of cables 123, which are connected to a controller (unshown). Further, the metallic plate 122 is provided with a pair of electric wires 124, through which the metallic plate 122 is connected with the thermistor chip 120. There is provided an elastic chip holding member (piece of sponge) 125 between the thermistor chip 120 and thermistor holder 121.

The temperature sensor 102 is covered with a sheet of heat resistant and electrically insulating substance (piece of polyimide tape, unshown, for example), which is wrapped around the temperature sensor 102 in such a manner that it surrounds the thermistor chip 120, the chip holding member 125, and the thermistor holder 121.

Further, the thermistor chip 120 is kept pressed against the heater 100, with the presence of the abovementioned piece of polyimide tape. The thermistor chip 120 changes in electrical resistance by an amount proportional to the temperature of the heater 100. Thus, it is possible for the controller (unshown) to detect the temperature of the heater 100 by reading the amount of the electrical resistance of the thermistor chip 120. The electrical power to be supplied to the heater 100 is controlled according to the detected temperature of the heater 100.

(Structure of Film Unit)

Figure 4:
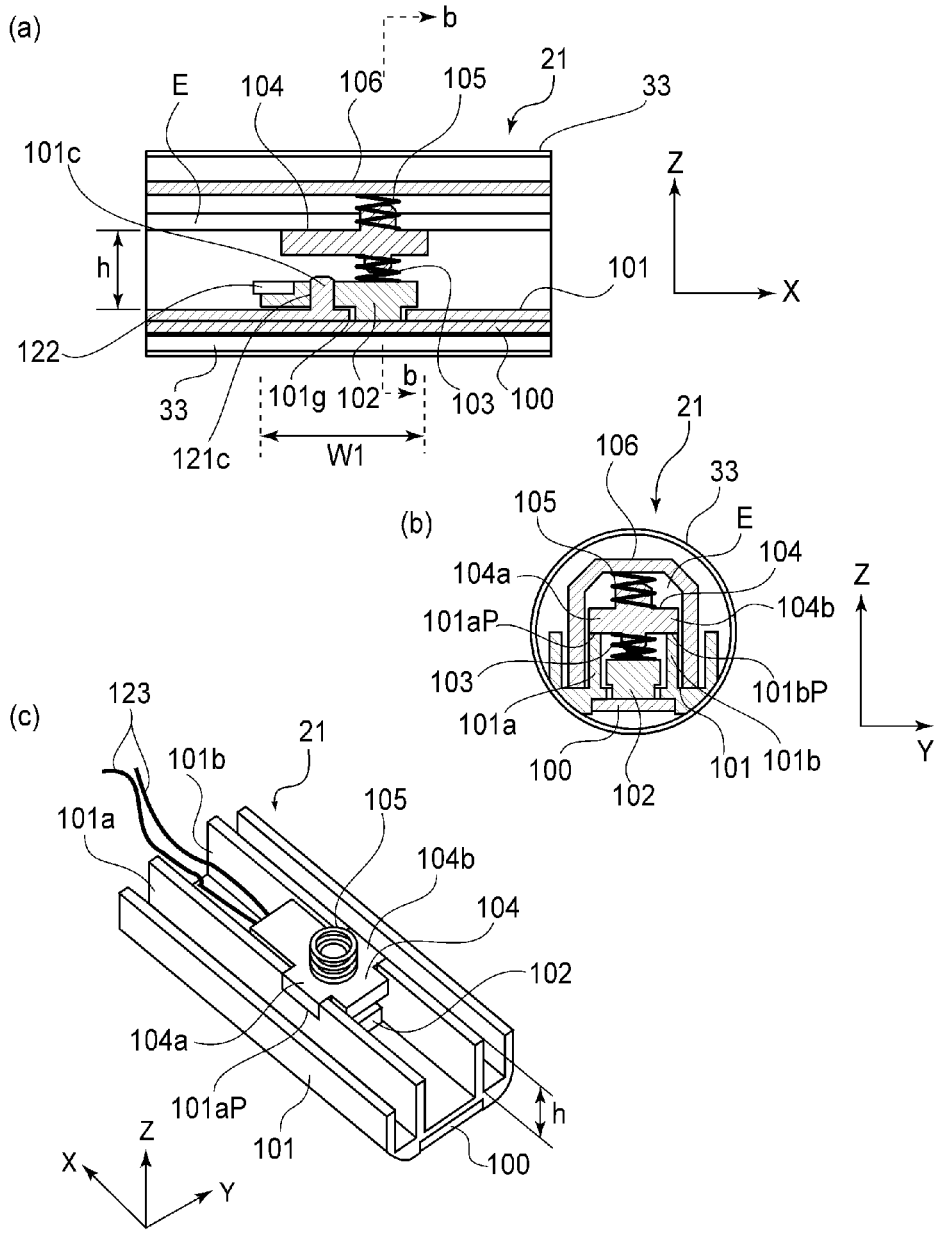
FIGS. 4(*a*)-4(*c*) are sectional and perspective views of the temperature sensor, and its adjacencies, of the film unit in accordance with the present invention.

FIG. 4(*a*) is a drawing which shows the structure of the temperature sensor 102, and its adjacencies, of the film unit 21. FIG. 4(*b*) is a schematic sectional view of the film unit 21, at a plane b-b in FIG. 4(*a*). FIG. 4(*c*) is a schematic perspective view of the portions of the film unit 21, shown in FIG. 4(*a*), minus the film 33 and the stay 106.

Referring to FIGS. 4(*a*) and 4(*b*), the stay 106 is in the form of a trough, which is roughly U-shaped in cross-section. It supports the heater holding member 101, across the entirety of the heater holding member 101 in terms of the direction parallel to the lengthwise direction of the heater 100, reinforcing thereby the heater holding member 101. The material for the stay 106 is metal. In this embodiment, it is zinc alloy coated steel. A reference letter E denotes the inward space of the stay 106. The stay 106 is under the pressure applied thereto by the load P through the regulating member 40 shown in FIG. 2B. Therefore, the stay 106 remains roughly fixed in position relative to the frame 41. Similarly, the heater holding member 101 and the heater 100 are under the pressure applied thereto by the load P through the stay 106, remaining thereby roughly fixed in position relative to the frame 41.

The thermistor holder 121 is provided with a through hole 121*c*, whereas the heater holding member 101 is provided with a boss 101*c*. Further, the boss 101*c* is fitted into the through hole 121*c*, whereby the temperature sensor 102 is roughly fixed in position in terms of the direction indicated by the arrow mark X. The sensor holding member 104 is placed in the space E. The pressing member 105 (second pressing member) is placed between the stay 106 and sensor holding member 104. Thus, it keeps the sensor holding member 104 pressed upon the heater holding member 101.

Further, a pressing member 103 (first pressing member) is placed between the sensor holding member 104 and temperature sensor 102. Thus, it keeps the temperature sensor 102 pressed toward the heater 100. The temperature sensor 102 is in contact with the heater 100 through a through hole 101*g*, with which the heater holding member 101 is provided.

Referring to FIGS. 4(*b*) and 4(*c*), the heater holding member 101 has a pair of walls 101*a* and 101*b*, which have positioning portions (recesses) 101*a*P and 101*b*P, respectively. This pair of walls 101*a* and 101*b* play the role of a conduit through which the pair of cables 123, which are connected to the temperature sensor 102, are guided outward of the film 33. Referring to FIGS. 2B and 4(*c*), the cables 123 extend outward of the film 33 between the walls 101*a* and 101*b*. The sensor holding member 104 has a pair of engaging portions 104*a* and 104*b* which engage with the positioning portions (recesses) 101*a*P and 101*b*P of the walls 101*a* and 101*b*, respectively. Referring to FIGS. 4(*a*) and 4(*c*), the height of the wall 101*a* and 101*b* is h. Further, referring to FIG. 4(*b*) and FIG. 4(*c*), in terms of the direction (indicated by arrow mark Y) which is perpendicular to the lengthwise direction (indicated by arrow mark X) of the heater 100, the positioning portions (recesses) 101*a*P and 101*b*P are on the outward side of where the temperature sensor 102 is positioned.

The film unit 21 is structured so that when the temperature sensor 102 is in contact with the heater 100, the amount of pressure generated by the pressing member 105 is greater than that by the pressing member 103. Therefore, the engaging portions 104*a* and 104*b* of the sensor holding member 104 remain in contact with the positioning portions (recesses) 101*a*P and 101*b*P of the walls 101*a* and 101*b*, respectively, whereby the sensor holding member 104 is kept accurately positioned in terms of the direction indicated by the arrow mark Z. Because the sensor holding member 104 is kept accurately positioned in terms of the direction indicated by the arrow mark Z, it is ensured that the temperature sensor 102 is kept in contact with the heater 100 by the pressure generated by the pressing member 103. The amount of pressure generated by the pressing member 103 is determined by the spring constant of the pressing member 103.

Figure 5:
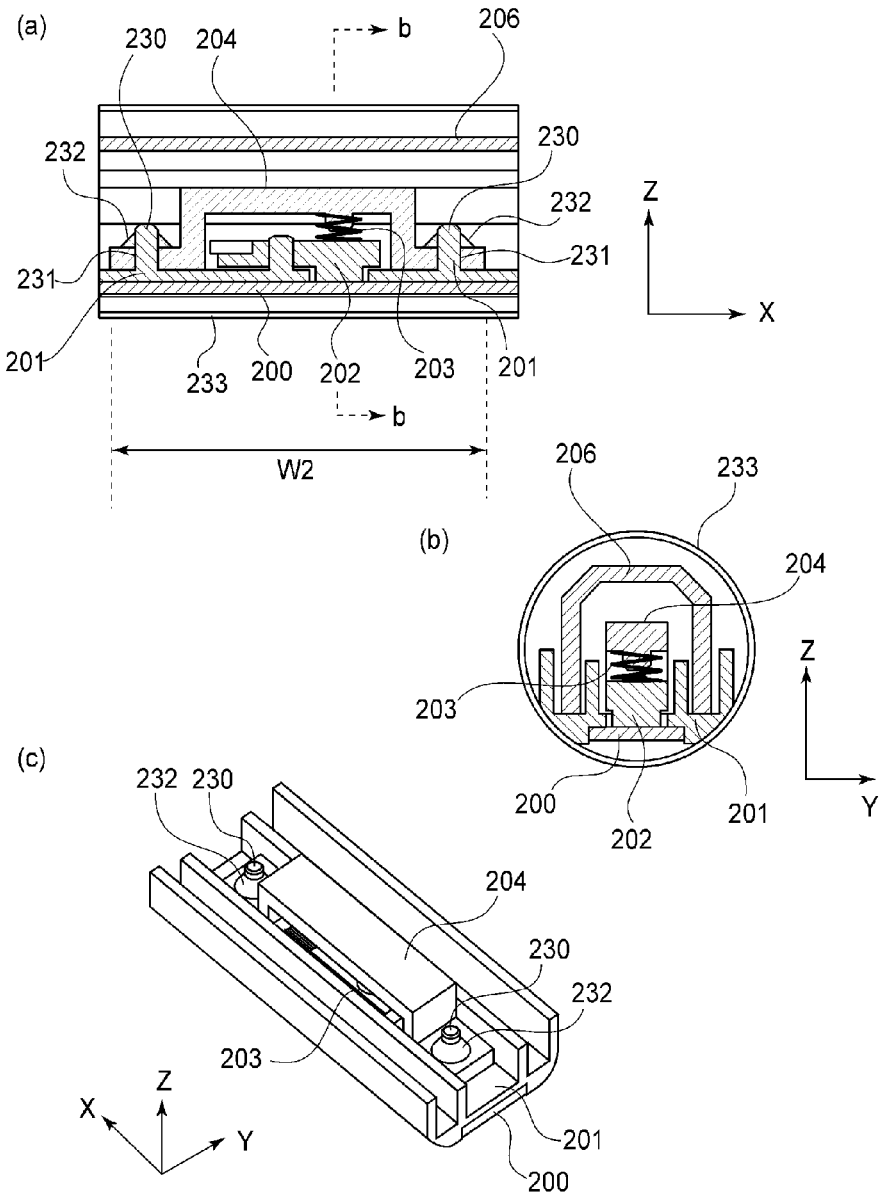
FIGS. 5(*a*)-5(*c*) are sectional and perspective views of the temperature sensor, and its adjacencies, of a comparative (conventional) film unit.

Referring to FIGS. 4(*a*)-4(*c*), because the film unit 21 is structured so that the sensor holding member 104 is positioned as described above, the sensor holding member 104 can be held to the heater holding member 101 without requiring a space which is necessary in a case where fastening members such as the ones shown FIGS. 5(*a*)-5(*c*) are used to keep the sensor holding member 104 accurately positioned relative to the heater holding member 101.

In order to fix the sensor holding member 104 to the heater holding member 101 with the use of fasteners, a certain amount of space is necessary. However, this embodiment makes it possible to eliminate the space which is required of the heater holding member 101 to hold the temperature sensor holding member 104. Therefore, this embodiment can reduce the heater holding member 101 in size. That is, this embodiment can makes it possible for the width W1 of the sensor unit, which is shown in FIGS. 4(*a*)-4(*c*), to be less than the width W2 of the sensor unit, which is shown in FIGS. 5(*a*)-5(*c*).

Further, there is disposed the sensor holding member 104 formed of heat resistant and thermoplastic (electrically insulating) resin, between the pressing members 103 and 105. The material for the sensor holding member 104 is LCP (Liquid Crystal Polymer), for example. Therefore, this embodiment can provide an ample distance between the temperature sensor 102 and the stay 104 formed of metallic plate, ensuring thereby that the temperature sensor 102 remains electrically insulated from the stay 106.

The pressing members 103 and 105 are in the form of a compression spring. Further, the film unit 21 is structured so that the pressing members 103 and 105 are coaxially positioned, and also, that the axial lines of the pressing members 103 and 105 coincide with the portion of the heater 100, whose temperature the temperature sensor 102 detects. That is, the pressing members 103 and 105 are positioned so that the thermistor chip 120 of the temperature sensor 102, the center line (axial line) of the pressing member 103, and the center line (axial line) of the pressing member 105, coincide.

Referring to FIGS. 5(*a*)-5(*c*), in the case of the comparative fixing device, the heater holding member 201 is fixed to the sensor holding member 204 with the use of the pair of fasteners 232. Therefore, if the sensor holding member 204 is imperfectly fixed to the heater holding member 201 with the use of the fasteners 232, it is possible that the sensor holding member 204 will be separated from the heater holding member 201, by the pressure generated by the pressing member 203, and therefore, the contact pressure between the temperature sensor 202 and heater 200 will become unstable.

In the case of the fixing device 20 in this embodiment, the pressing member 105 is greater in resiliency than the pressing member 103. Therefore, it is ensured that the engaging portions 104*a* and 104*b* are not separated from the positioning portions (recesses) 101*a*P and 101*b*P, respectively, by the resiliency of the pressing member 103. Therefore, it is possible to reduce the contact pressure between the temperature sensor 102 and the heater 100 in the film unit 21. Therefore, it is ensured that the heater temperature is accurately detected.

Further, in the case of the fixing device shown in FIGS. 5(*a*)-5(*c*), it is possible that the sensor holding member 204 will be deformed by the pressure from the pressing member 203, and therefore, the pressing member 203 will be reduced in the effective amount of pressure it can applied to the sensor holding member 204.

In comparison, the fixing device 20 in this embodiment is structured so that the thermistor chip 120 of the temperature sensor 102, the axial line of the pressing member 103, and the axial line of the pressing member 105 align (coincide).

Since the axial line of the pressing member 103 and the axial line of the pressing member 105 coincide (align), the amount of the pressure applied to the engaging portions 104*a* and 104*b* of the sensor holding member 104 is equal to the difference between the resiliency of the pressing member 103 and that of the pressing member 105. Thus, this embodiment can reduce the extent to which the sensor holding member 104 is deformed.

Further, referring to FIGS. 4(*b*) and 4(*c*), the amounts of pressure generated by the pressing members 103 and 105 are borne by the engaging portions 104*a* and 014*b* of the sensor holding member 104, which are aligned in the widthwise direction (indicated by arrow mark Y). Therefore, the sensor holding member 104 is less likely to be deformed than the counterpart of the comparative fixing device.

As will be evident from the foregoing description of one of the embodiments of the present invention, the present invention can substantially reduce the amount by which the sensor holding member 104 is deformed. Therefore, it can reduce the effective amount of pressure applied to the sensor holding member 104 by the pressing member 103. Therefore, it can keep stable the state of contact between the temperature sensor 102 and heater 100. Therefore, it can make it possible for the temperature of the heater 100 to be accurately detected.

Further, the present invention can provide a fixing device which is substantially smaller in the dimension of its sensor unit in terms of the lengthwise direction of its heater than any fixing device in accordance with the prior art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 029721/2013 and 010990/2014 filed Feb. 19, 2013 and Jan. 24, 2014, respectively, which are hereby incorporated by reference.

What is claimed is:

1. A fixing apparatus comprising:

a heater;

a heater holding member configured to hold said heater;

a temperature sensor, provided in contact with said heater through a hole provided in said heater holding member, configured to detect a temperature of said heater;

a sensor holding member configured to hold said temperature sensor; and an urging member, provided between said temperature sensor and said sensor holding member, configured to urge said temperature sensor toward said heater, wherein said heater holding member includes a positioning portion configured to determine a position of said sensor holding member with respect to an urging direction of said urging member, and wherein said positioning portion is disposed at a position outside of a position of said temperature sensor with respect to a direction perpendicular to a longitudinal direction of said heater.

2. An apparatus according to claim 1, wherein said positioning portion is on a projection of said heater holding member.

3. An apparatus according to claim 2, wherein said projection is configured to guide a cable connected to said temperature sensor.

4. An apparatus according to claim 1, further comprising a stay reinforcing said heater holding member, and a second urging member, provided between said stay and said sensor holding member, configured to urge said sensor holding member toward said positioning portion.

5. An apparatus according to claim 4, wherein an urging force of said second urging member is larger than that of said urging member.

6. An apparatus according to claim 4, wherein said urging member and said second urging member are disposed substantially on a line in which a temperature detecting element of said temperature sensor extends.

7. An apparatus according to claim 4, wherein said sensor holding member is made of insulative material.

8. An apparatus according to claim 1, further comprising a cylindrical film having an inner surface to which said heater is contacted.

* * * * *